United States Patent [19]

Vincens

[11] 4,051,640

[45] Oct. 4, 1977

[54] COMPOSITE STRUCTURES

[76] Inventor: Rene F. Vincens, 92a Route de Geneve, 1028 Preverenge, Switzerland

[21] Appl. No.: 652,097

[22] Filed: Jan. 26, 1976

Related U.S. Application Data

[63] Continuation-in-part of Ser. No. 589,880, June 21, 1975, abandoned, which is a continuation-in-part of Ser. No. 385,804, Aug. 6, 1973, abandoned.

[30] Foreign Application Priority Data

| | | |
|---|---|---|
| Aug. 8, 1972 | France | 72.28635 |
| Jan. 26, 1973 | France | 73.02920 |

[51] Int. Cl.[2] ..... E04B 5/48; H02G 3/00

[52] U.S. Cl. ..... 52/220; 174/101; 52/732; 52/619

[58] Field of Search ..... 52/220, 270, 730–732, 52/619; 138/157, 163; 174/68 C, 101

[56] References Cited

U.S. PATENT DOCUMENTS

| | | | |
|---|---|---|---|
| 800,054 | 9/1905 | Ayres | 174/101 |
| 1,217,398 | 2/1917 | Bonnell | 138/157 |
| 1,608,672 | 11/1926 | Rappaport | 52/731 |
| 1,853,090 | 4/1932 | Smiley | 52/730 |
| 2,697,453 | 12/1954 | Formenti | 52/731 |
| 2,730,210 | 1/1956 | McLaughlin et al. | 52/619 |
| 2,762,398 | 9/1956 | Adam | 52/220 |
| 3,540,116 | 11/1970 | Drahos et al. | 52/619 |
| 3,596,424 | 9/1969 | Ward | 52/619 |
| 3,757,485 | 9/1973 | Vincens | 52/731 |
| 3,813,840 | 6/1974 | Wagenknecht | 52/619 |

*Primary Examiner*—Price C. Faw, Jr.
*Assistant Examiner*—James L. Ridgill, Jr.
*Attorney, Agent, or Firm*—Robert E. Burns; Emmanuel J. Lobato; Bruce L. Adams

[57] ABSTRACT

A composite structure, comprising supporting members and connection bridges. Each supporting member comprises a beam, a girder or a panel, and is longitudinally recessed over at least part of at least one longitudinal face. The recessed supporting member has a web, which is preferably resilient and which in effect constitutes the bed of a longitudinally extended channel, having on each of its two sides a locking recess. Each locking recess is bounded by a flank, or bank of the channel, forming one of the sides of the supporting member. The combination also includes connection bridges, each constituting a modular unit. At least parts of these bridges are dimensionally adapted to the shape and dimensions of the supporting members. Each bridge is transversely elastically fitted into the recessed portion of such a member so as to become fixed thereto and to resist longitudinal wrenching and displacement therein or therefrom. The preferred structure also includes minisections interposed between the supporting members and the connection bridges.

9 Claims, 37 Drawing Figures

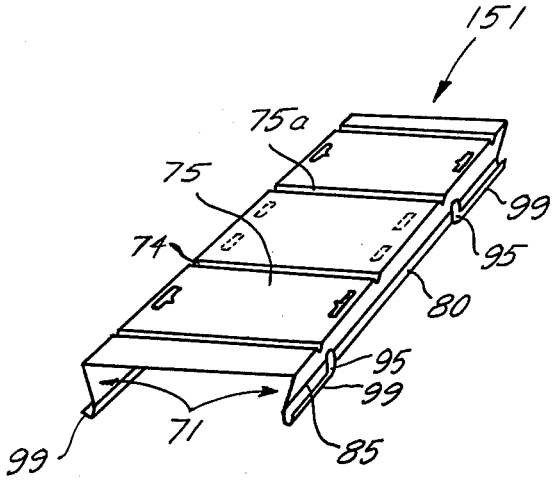
FIG. 5
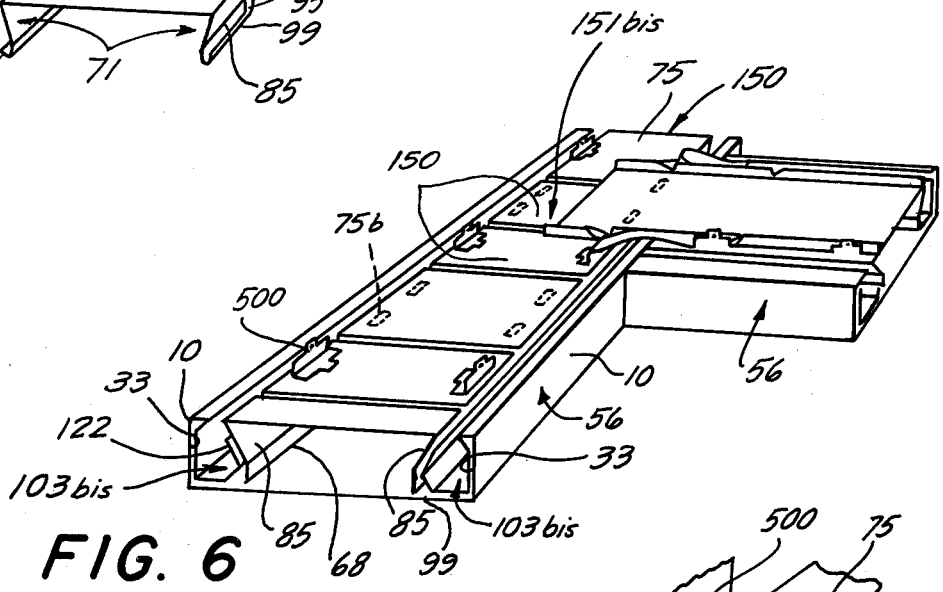
FIG. 6
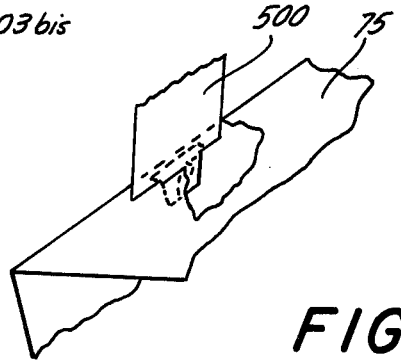
FIG. 7
FIG. 6A
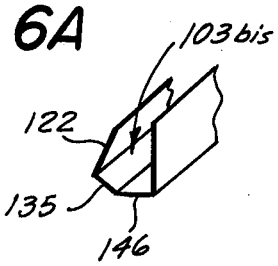

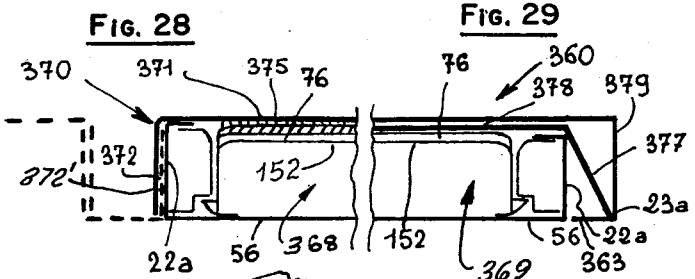
Fig. 29
Fig. 28
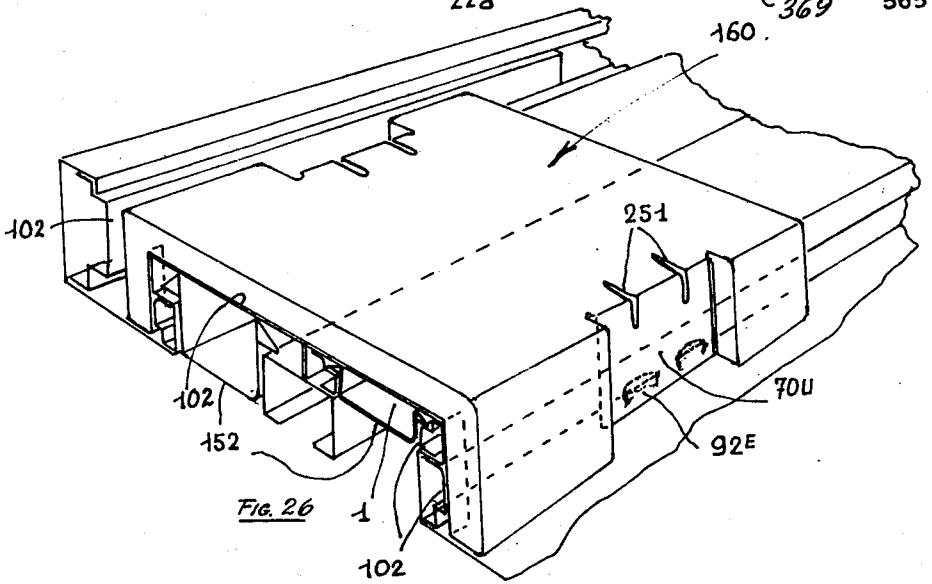
Fig. 26
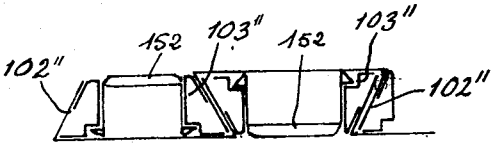
Fig. 27

COMPOSITE STRUCTURES

CROSS-REFERENCE TO PRIOR APPLICATIONS

This application is a Continuation-in-part of application Ser. No. 589,880 filed June 21, 1975, now abandoned, a Continuation of the applicant's original application Ser. No. 385,804 filed Aug. 6, 1973 now abandoned. It claims the priority of the French Applications No. 7228635 filed Aug. 8, 1972 and No. 7302920 filed Jan. 26, 1973.

BACKGROUND OF THE INVENTION:

This is an improvement on the applicant's earlier composite structure described in U.S. Pat. No. 3,757,485, assigned to the assignee hereof. In the earlier construction a main support member or joist was formed of two outer sheaths, with stiffening bridge means internally interconnecting the sheaths and spacing them apart. In the art of construction with standardized elements, considerable advance was made by the construction disclosed by the applicant's earlier patent. However, limitations and problems have remained. One of them was that the stiffening bridge means had to be inserted in a joist by longitudinal sliding. This was complex and expensive and was not always conducive to an arcuate structure.

Another type of composite structure is known from British Pat. No. 930,827. This structure comprises a wall of partitions, with vertical spaced pillars and panels located therebetween. The pillars are equipped with detachable sections and clips for attaching them to the panels. The patent proposes specific limited structure, not construction based on standardized elements and particularly not a construction of wide applicability and which can be completed readily and permanently.

U.S. Pat. No. 3,034,609 discloses a partition wall structure comprising horizontal and vertical elements which form a framework with grooves, parallel spaced apart panels transversely fitting into the grooves, and a number of feet supporting the assembly. The connection of the panels to the elements forming the framework according to this patent is made by flexible clips while the framework is connected to the feet by bolts.

These several types of connecting means and composite structures comprising them are well known in the art. They are also known to have a number of defects and drawbacks. Among other things, they are hard to assemble. When assembled, they are not always reliable. Their structure, and also their appearance, is not always satisfactory.

SUMMARY OF THE INVENTION

The invention avoids the defects and drawbacks of the prior art by using a new combination of elements. The new combination comprises at least one supporting member such as a beam, a girder or a panel, longitudinally recessed over at least part of at least one longitudinal face. The recessed member has a web, which is preferably resilient and which constitutes the bed of a longitudinally extended channel, having on each of its two sides a locking recess. Each locking recess is bounded by a flank, or bank of the channel, forming one of the sides of the supporting member.

The new combination also includes connection bridges, each constituting a modular unit. At least parts of these bridges are dimensionally adapted to the shape and dimensions of the supporting member. Each bridge is transversely elastically fitted into the recessed portion of such a member so as to become fixed thereto and to resist longitudinal wrenching and displacement therein or therefrom.

Preferably the new combination also includes locking members coacting with the supporting members and with the reenforcing bridges and effectively interposed between the two. These locking elements will also be identified as "minisections". They generally extend along the supporting members, are locked to the same, and are also locked to the reenforcing bridges, or —otherwise expressed— the bridges are locked to them and thereby to the supporting members.

Each of the bridges preferably constitutes a rigid body which is partially hollow. It has two opposite sections, applied against two facing flanks of the supporting member and matching the shape of each flank. Spurs are seated in at least one of the flanks, and are concealable in the recessed portion of each support member. The bridge advantageously has a deck and, on each of the two opposite edges of the deck, a bearing section forming a pillar. The pillars are applied with friction against the locking elements or sections of the supporting member or locking members into which the bridge is fitted.

Multiple opportunities are offered by the new construction, wherein bridges can be instantaneously fitted. Bridge locking elements can act either towards the inside of the bridge arch or towards its outside, or in both directions at once if required. Mini-sections are generally provided, the flanks of which act on the bridges and act inversely as braking jaws. The present invention thus makes it possible to extend the field of applications of modular elements and of composite structures using them, the bridges and the minisections. This is achieved by a highly-developed technology, capable of drawing maximum advantage from the bridges, directly and instantaneously fittable onto sections, the recess part of which has an overall C-shape. These sections are hereinafter termed supporting members in the composite structure, the construction of which they permit.

The overall form of a supporting member as defined, having an overall C-shape, can be in effect provides a channel-shaped section which can also be said to be substantially U-shaped, having a flat or twisted web laterally extended on each side by a wing of variable shape. The wing has on its internal surface a profiled locking element under which is thus formed a locking recess. Exceptionally the locking means for a supporting member can be sectorally formed over a part of its length in order to form one or more recesses with varying longitudinal spacing between them. The locking elements can in this case be concave or convex fittings for holding the bridges and for thus forming sectorally arranged supporting members.

A bridge for the new structure comprises an open or closed, rigid deck, laterally extended on each of its two sides by a pillar, which desirably comprises locking and supporting elements. The internal section of a bridge in effect constitutes an arch. Such a bridge is instantaneously fitted, and is held in one or more supporting members, which it reinforces sectorally.

The invention provides the advantage, among others, of a rational and economic use of bridges and supporting members. The supporting members can be extremely narrow or very broad, and can be made of materials which are thin or thick, rigid or semi-rigid, weldable or not, for example in the form of drawn, extruded or cut-out sections. The bridges can now be adapted economically to these supporting members. Furthermore, the mini-sections as defined above are simplified and the possibilities for their use are extended, while their efficiency as angular connections is reinforced.

The supporting members and bridges can vary from a few centimeters to a few tens of centimeters in width. Their pillars can be a few millimeters to several centimeters high. This variability which respects the same principles entails slight constructional modifications.

The locking elements have sharp edges and are designed to penetrate easily between the flanks of a channel and the modular bridges, to permit instantaneous fitting into the channel of a supporting member.

These elements can be fitted indirectly, with the aid of straight or angulate mini-sections the shape of which is more or less than of a U. They are preferentially made of shaped steel, more particularly the angular mini-sections, the wings of each branch of which are relatively flexible and can be fitted by force and by friction into the locking recess of a supporting member. Each mini-section comprises a relatively rigid web, laterally extended on each of its two sides by at least one wing. These three distinct parts can be either twisted, perforated, notched or shaped to form locking spurs in order to improve the seating of the mini-sections fitted into their locking recess and to participate effectively in the securing of the bridges, and various other optional accessories.

In composite structures according to the invention, using supporting members of thin or semi-rigid material, the mini-sections fitted are designed so that the pressure necessary for the fitting of the bridges is localized in the inside angle of the locking recess closest to the bed of the channel which is tensioned by the bridges, and not in the flanks, so that the flanks are not deformed.

BRIEF DESCRIPTION OF THE DRAWINGS

FIGS. 1-A, 2, 2A, 3, 3A, 4 and 4A are similar views of modified composite structures according to the invention.

FIG. 5 is a perspective view of a bridge for use in a composite structure according to the invention.

FIG. 6 is a perspective view of such a composite structure.

FIGS. 6A, 7 and 8 are perspective views of details from FIG. 6.

FIGS. 26 to 30 show additional composite structures in accordance with the invention.

DESCRIPTION OF PREFERRED EMBODIMENTS

The composite structure includes at least one supporting member such as a beam, of single or combined construction, made of any material or combination of materials, rigid or semi-rigid, such as metal, wood, or plastic material for example.

The supporting member can have the form of a section or a combination of sections of a solid material forming a panel 1, or of a cut-out or drawn structural shape or profile 50, 55 as indicated in FIGS. 1 to 8.

The supporting member 1 has, over at least one of its faces, at least one longitudinally extended recess, shown by the thick line, thus providing a U-shaped section, constituting the bottom section of a channel.

Figure 2:
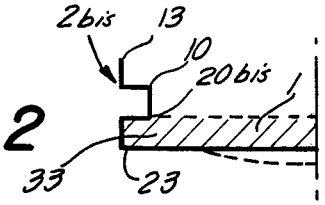
Figure 2A:
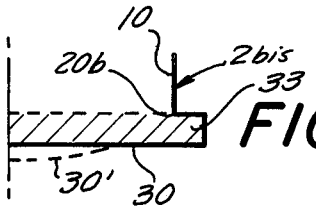

A supporting member 50 or 55 which is drawn, extruded or cut out of any material, also provides a channel 2, with flanks 10 more or less scarped and forming as a whole an insertion basin of U-shape section as shown in FIGS. 2, 2A, the central web and two lateral wings or flanks of which can have more or less twisted cross-sections as illustrated in FIG. 2 by the inward, upward, outward and upward orientations of flank 2bis. They can also be elastically twisted in use, as illustrated by the web sections 30, 31' in FIG. 2A.

The two flanks 2bis have on their internal surfaces 10, locking edges or projections 20 or 20 bis.

Figure 1:
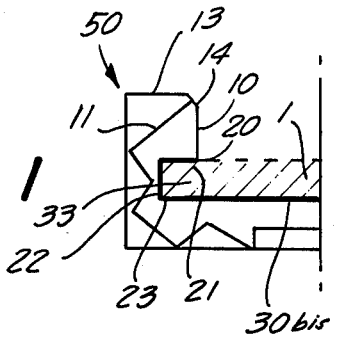
FIG. 1 is a schematic view, in cross-section, of a composite structure according to the invention.
Figure 1A:
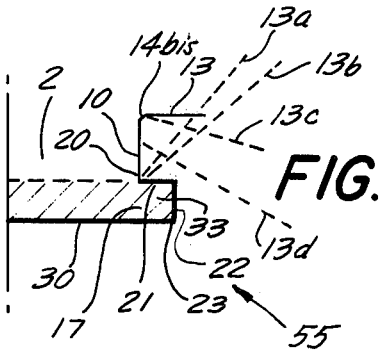

As shown in FIGS. 1 and 1A, the base of web or bottom part or bed of channel 30 is laterally linked to flanks 22 which have inwardly extending at right-angles thereto, locking wings 21 terminating at projections 20 and surmounted by flanks 10, all extending longitudinally and limiting channel 2 of the supporting member.

A flank 10 can be connected at its top to a flank top 13 following a fairly large radius 14 or inversely following a short radius 14bis. The flank is connected at its bottom to the bed of channel 30 forming an edge or projection 20, facing towards the central section of channel 1.

Projection 20 is flanked laterally by two wings 21 and 22, which advantageously are perpendicular to one another, linking it to bed 30 and forming a locking recess 33 which has a cross-section of general C-shape thus forming an adjacent internal angle 23 between bed 30 and internal bottom flank 22. The locking recesses 33 face towards one another. With bed 30 they define the bottom section of the channel. FIG. 1A shows possible modifications of the external flanks, forming variously angular extensions or flanks 13*a*, 13*b*, 13*c*, 13*d*. Similarly the shaded part 17 indicates that various convex or concave shapes can be provided in the channel section; they do not affect the functional role of the bottom section of channel 1.

Figure 3:
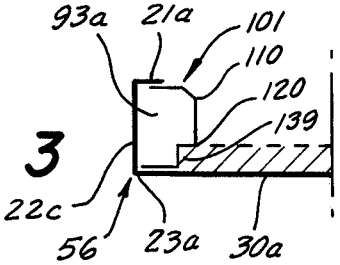
Figure 3A:
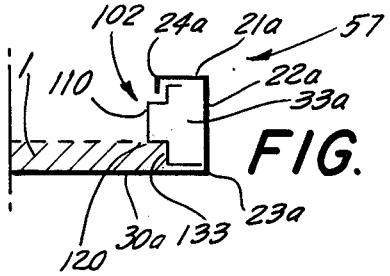

FIG. 1, illustrating section 50, shows a zig-zag line 11, indicating that the channel and the flanks thereof can also have a shape very different from those described so far. Still other forms are shown in FIGS. 3, 3*a*. In all cases the channel can be simply, extremely economically made of thin, rigid or semi-rigid material, in folded or profiled shape for example. As shown in FIG. 3, a section 56 has a bed 30*a*, an internal adjacent angle 23*a*, an internal flank 22*a*, and a locking wind 21*a*, constituting the locking recess 33*a*, into which is fitted over part or all of its length at least one mini-section 101 or a projection 120 and a mini locking recess 133. The locking wing 21*a* of this section 57 is extended longitudinally and perpendicularly by a supplementary locking wing 24*a*, the ridge of which is orientated in the direction of base 30*a* forming the bed of the channel and defines a locking recess 33*a* which is here fitted with a mini-section 102 which also has a locking recess 133, a projection 120 and a flank 110.

Thus FIGS. 1 to 3A illustrate ways in which the channel of a supporting member can be combined with bridges in order to form a composite structure according to the invention.

Figure 4:
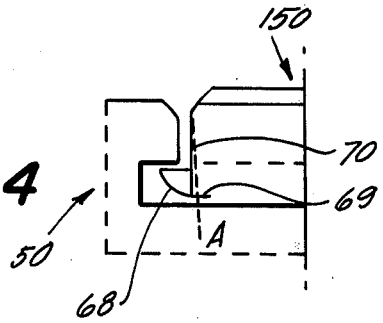
Figure 4A:
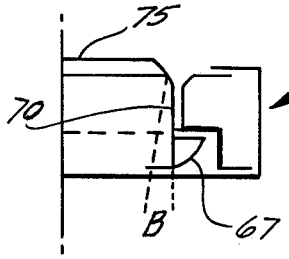

FIGS. 4 and 4A show overall views of arched bridges 150, fitted either to a supporting member 50, or to a member 56. Schematically, the reinforced deck 75 is shown as extended laterally on two sides by two pillars 70 thus providing a more or less U-shaped section the wings of which may slightly diverge, before assembly, from the deck 75.

Each pillar is extended longitudinally at its base by a wing 69 generally turned towards the inside, below deck 75 and parallel to the latter. An angulate base 67, 68 is also attached to the base of each pillar 70; it extends outwardly and may be slightly rounded to facilitate its insertion into a channel to provide a locking spur.

FIG. 4 shows pillar 70 with very slight setting back of its contact area, as shown by the dotted line A. In FIG. 4A the supporting member 56 receives pillar 70, in which the setting back, shown by angular dotted line B, is more pronounced then at A. This setting back of the bearing section of the pillar 70, illustrated at A, permits increasing the friction with the flank with which the pillar is in contact.

The relatively rigid bearing elements of a resilient bridge pillar 70 act on each supporting member 50,56, directly or indirectly, by friction like brake jaws. Reciprocally the resilient supporting member acts similarly on the bearing elements due to the reciprocity of the shape of their parts in contact, which resemble by the jaws of a vise. The various sharp-edged locking elements 67, 68 etc. are intended to provide permanent and localized friction of the bearing elements, after fitting, whatever the stress and strains to which the elements thus fitted together are exposed.

Thus in order to avoid deformation of a supporting member, made for example of a thin material, the bridge may have on its pillars external bosses or shaped projections 67, 68 etc. which permit the locating of the pillar sections in contact with the flank belonging to or related to a supporting member.

Figure 8:
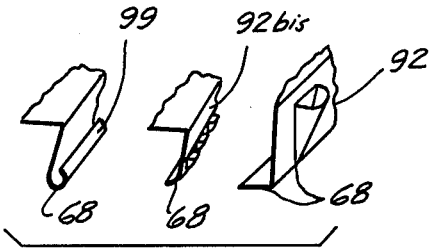

FIGS. 5, 5bis, 6, 7, 8 illustrate important features of the present invention, which can be summarized as follows:

A hollow, arched bridge 151 has, as shown in FIG. 5, a deck 75*a* with reinforcing ribbing 74, and two pillars 71 forming with the deck an essentially U-shaped section. This section is here shown as slightly trapezoidal, matching the shape of flank 122 of a mini-section 103 bis (FIG. 6bis), which has a locking recess 135. Each pillar 71 has a bearing section 80 separated by notches 95 from the independent locking sections 85 which can be equipped if desired with different shapes of sharp-edged locking spurs, as shown in FIG. 8, or 99 as shown in FIG. 5.

FIG. 6 illustrates bridge 151 fitted between two mini-sections 103bis themselves forming two supporting members 56 connected to provide a right-angle composite structure or angle-piece.

FIG. 7 shows a tooth 500 belonging to male deck 75*b* allowing connection with female deck 75*a* in order to form a main beam by joining two supporting members for bridge decks face-to-face.

Figures 9, 10, 11, 12, 13, 14, 15, 16, 17, 18, 18A:
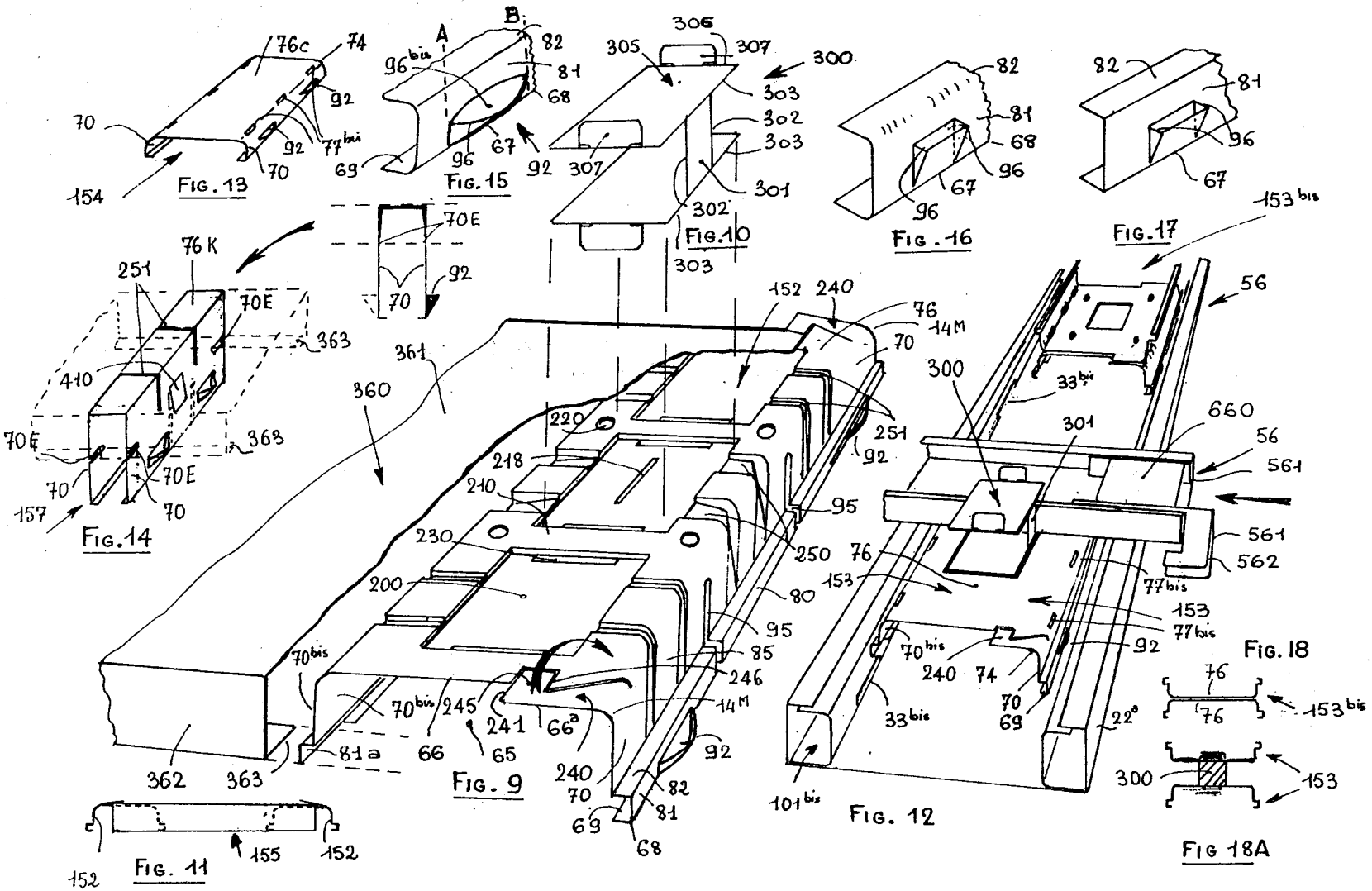
FIG. 9 is a cut-out perspective view of an embodiment of the invention, showing an arched bridge partially engaged in a detachable deck to provide a shell bridge.
FIG. 10 is a perspective view of a detail from FIG. 9 showing a detachable cross-bracing flange ready to be fixed onto the deck of the shell bridge.
FIG. 11 is a view in cross-section of a modification of FIG. 9, showing two arched bridges assembled by a detachable deck and constituting a shell bridge.
FIG. 12 is a perspective view of another embodiment, showing a supporting member comprising at the front an arched bridge of average dimensions, ready to be joined with a cross-bracing flange and a partial view of a linking supporting member, and at the back a fitted cross-bracing bridge.
FIG. 13 is a perspective view of an arched bridge with sharp-edged locking spurs.
FIG. 14 is a perspective view of an arched bridge of very low height with bearing and locking pillars which are relatively high and a schematic view in cross-section of this bridge comprising as an option a single pillar for locking.
FIGS. 15, and 16 and 17 are perspective views of three types of locking devices with their edges.
FIGS. 18 and 18A are schematic cross-sections of cross-bracing arched bridges.

The hollow arched bridge 152 shown in FIG. 9 is often preferred from both the view of fabrication and the point of view of performance and reliability. —It increases the manufacturing tolerances, and reduces the cost. This bridge 152 is more or less U-shaped as a section with two twisted wings slightly open extending its web constituting rectangular deck 76 and providing access to arch 65 via a ridge 66 substantially constituting its width.

Deck 76 has three rectangular basins, which constitute a means for stiffening the bridge in all directions and thus form passages 200 comprising perforations 220 which can receive bolts and other fittings, among other things. Each of the three basins has rectangular holes 230 on each of the edges parallel to ridge 66. Each of the longitudinal sides of deck 76 is extended laterally more or less at a right-angle by a pillar. One pillar 70 has a length equal to that of the largest side of deck 76, and the other pillar 70bis is slightly narrower and equal to the shortest side of the deck; the reduction in length of the deck is made at the level of ridge 66 on the level of a locking catch 240.

A locking catch 240 is formed by a cut-out of deck 76. It constitutes a notched foot contiguous to pillar 70 thus defining the adjacent angle 241 of ridge 66*a* by a longitudinal cut-out of the deck, returning to a right angle and parallel to ridge 66*a*. This cut-out continues at a right-angle towards ridge 66*a*, which constitutes locking foot 245 and defines stop ridge 246 of the deck, the said locking foot being mobile on its base contiguous to the pillar according to a cut-out at an angle of about 45° in relation to stop ridge 246 and downwards towards the base of the pillar. Pillars 70 and 70bis have a common overall shape and are longitudinally contiguous to the deck of which they constitute the extension and following a radius 14 M. The bottom section of each pillar forms a projection, facing arch 65 and receptive of the bridge supports. This form has a substantially U-shape of which bottom wing 69 constitutes the part applied to the bed of a channel. It is longitudinally extended by web 81 which is applied to the flank of a channel itself extended also at a right-angle by the final wing 82 forming the size of the projection, the said wing being connected at a right-angle to pillar 70 or 70bis of which it forms part.

Web 81 of the projection of pillars 70 of these arched bridges 152 has locking spurs 92, to avoid wrenching part 80, which is relatively independent of the locking part 85, there being a slot extending from central basin 200 to rejoin at zero depth the attached edge of wing 82.

The two independent locking parts 85, located at each end of a pillar are also reinforced by two ribs 251, designed in the same way as the central reinforcement 250.

The bearing wing 69 at the base of pillar 70bis is cut out over a length of 10 mm. and on the level of the web edge 81*a* to form a free passage necessary to make a shell bridge as will be seen below.

As shown by FIG. 9 (also 10–23) basins 200 of deck 76 are designed to take cross-bracing flanges 300 which are fixed and welded or detachable in conformity with FIG. 10, each flange having substantially a U-shape of which web 301 is shorter than its two wings so as to form a fork formed by edge 32 of web 301 and that 303 of each of the two wings 305 which each have on their two edges 306 a perpendicular wing 307, the purpose of which is to penetrate through hole 230 to be subsequently folded down under the arch of the deck of the bridge after penetration.

Shell bridges 155, as shown in profile view in FIG. 11 are made by means of bridges 152. The shell bridges 155 allow the making rigid and/or connection of supporting members advantageously made of steel, with a lateral wing. To form a shell bridge 155, two bridges 152 are linked by a C-section 360 which joins them at each of its two open ends and which has a web 361 longitudinally extended and at a right-angle to two lateral wings 362, itself simultaneously extended by a second wing 363. Instantaneous fitting of a bridge 152 is effected by engaging this bridge on pillar 70bis side inside wings 362, the two opposite edges 81*a* resting on the inside of wing 362, web 363 in contact with deck 76 engaging under foot 245 which has been raised beforehand and the top-end of wings 362 stopped up against edge 246 of the bridge deck. The combined pressure of two flanks in a supporting member gives the assembly the required rigidity.

FIG. 12 illustrates a supporting member 56 having wings 22*a*, into which a bridge 153 of low pillar height is ready to be inserted. Of the same type as bridge 152 it has on its deck 76 a shaped basin 200 ensuring its reinforcement and connection with a cross-bracing flange 300. An element 74, prolonging deck 76 with pillar 70, has perforations 77bis facilitating the penetration of the bridge, as shown at A in FIG. 4. Four locking spurs 92 project from bridges 152 at the base of wings 69.

Bridge 153 equipped with a locking catch 240, has a cross-bracing flange 300 fixed onto deck 76, of which the locking fork holds a supporting member 56 of which a bridge 660 blocks the two mini-sections 561 one of which has two lateral wings forming at the ends hook 562 which can hook web 301 of cross-bracing flange 300.

Shown at the back of FIG. 12 and also in FIG. 18 is a cross-bracing bridge 153bis i.e. two bridges 153 connected by their deck 76 which are welded, web to web, which permits the construction of either a closed main beam. Two supporting members can also be joined face-to-face forming an enclosed space by means of flange 300, provided by two bridges 153 joined back-to-back, FIG. 18A.

FIG. 13 illustrates a low bridge 153 with deck 76 C and pillar 70, connected by an element 74 which has perforations 77bis to increase the flexibility of entry of pillars 70 into the supporting member. sharp-edged spurs 92 are provided on the pillars.

FIG. 14 illustrates a bridge 57 with very small deck 76 K and suitable pillars 70. It constitutes an excellent means of connecting supporting members. It differs from the preceding bridges in its small width, and is accordingly insertable into a very narrow channel. This bridge 57 is characterized by notches 70E, parallel to the length of deck 76 K and longitudinally extending into a pillar 70. These notches permit the passage of wings 363 of a section 360 in order to form shell bridges with a variable number of pillars, each bridge 57 then forming a pillar with two inverse effects, bearing and locking, and capable of penetrating one of the channels of the same supporting member.

FIGS. 15, 16 and 17 illustrate three versions of locking spurs, all three fitted onto the base of a pillary 70. Each spur can thus either be fitted into a profiled or perforated locking recess, of a mini-section for example, which eliminates the need to perforate a supporting member which would no longer be a modular element and in general would thus considerably increase the cost prices while impairing the esthetic effect.

FIGS. 16 illustrates a spur on which the projections act both like those shown in FIG. 15 and those shown in FIG. 16, which constitutes a perforation of a mini-section, the mini-sections being, as will now be seen, also locked in the supporting member which they constitute.

FIGS. 19, 20, 21 and 22 illustrate four versions of modular mini-sections which have the common feature of being able to fit laterally and instantaneously into the locking recesses 33 of the channels of the supporting members illustrated in FIGS. 1 to 3A. They have a substantially U-shaped section. Even under the most unfavorable circumstances for use, i.e. when fitting into a recess 33 of a supporting member 56 of very thin steel, they are capable of transmitting and localizing all the lateral thrust of the bearing sections of pillar 70 in adjacent angle 23*a* in such a way that lateral wing 22*a* is not deformed in any way, the thrust of pillar 70 being designed to give longitudinal blocking without shift of the mini-section, the bridge being in its turn locked by the mini-section.

Figures 19, 20, 21, 22, 23, 24, 24A, 25:
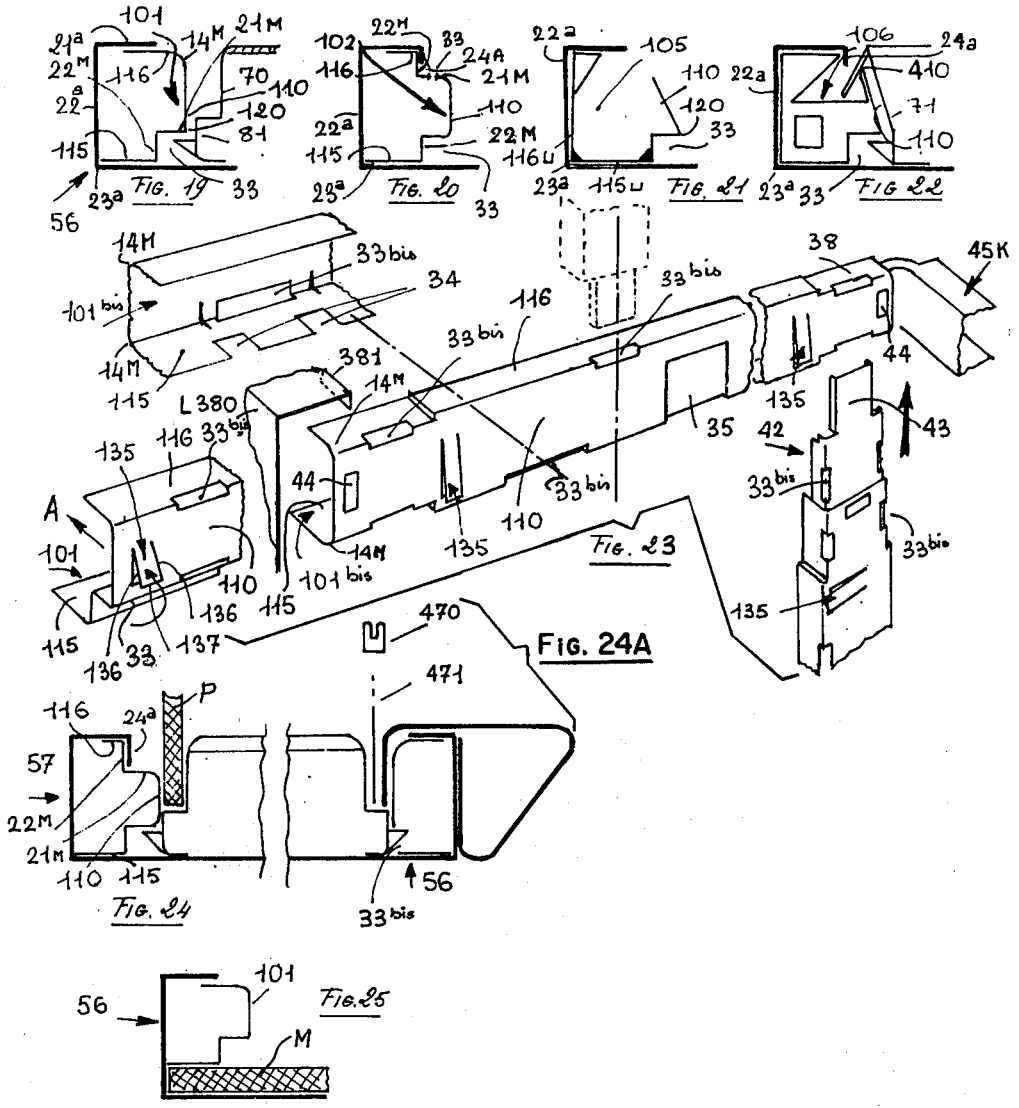
FIGS. 19, 20, 21 and 22 are schematic cross-sectional views illustrating mini-sections, fitted together.
FIG. 23 is a perspective schematic view of mini-sections, showing notched sharp-edged perforations, locking spurs, and an angle-connection thereof during assembly.
FIG. 24 is a schematic cross-sectional half-view of an embodiment with a fitted bridge supporting member, and mini-section.
FIG. 24A is a similar half-view, showing a gap between a pillar and the flank of a mini-section, for introduction of elements of variable shape with or without perforation.
FIG. 25 is a cross-sectional view of another combination of a supporting member, a mini-section, and another element.

FIG. 19 illustrates a mini-section 101 the web of which forms flank 110, the projection 120 which is longitudinally followed and at the right-angle by a wing 21 M also extended by a wing 22 M and thus forming a step limiting locking recess 33, wing 22 M parallel to the flank is followed at a right-angle by the bottom support wing 115 the edge of which comes up against adjacent angle 23*a*. Flank 110 is at the top longitudinally extended, more or less at a right-angle, by a wing 116, less wide than wing 115, at an angle 14 M having a suitable radius to facilitate penetration of the base of the bridge pillars. The edge of wing 116, not coming into contact with wing 22*a*, is simply coupled by its lateral external face to the internal part of wing 21*a*. The projection wing 81 of a pillar in this case comes up against flank 110 close to projection 120 and contributes to a localizing of pressure in angle 23*a*.

FIG. 20 illustrates mini-section 102 combined with supporting member 57. It differs from mini-sections 101 by a locking recess 33 which is also profiled or shaped and located laterally on each of the two sides of flank 110 and in this case wing 22 M permits the locking of wing 24*a* of the bearing element and due to modular perforations existing in wing 21 M making it possible to place a locking flange between these perforations and that central 218 of a deck 76 in order to prevent the supporting member from opening or being deformed; wing 116 is very narrow to facilitate fitting of the mini-section.

FIG. 21 illustrates a mini-section 105 substantially U-shaped with two slightly closed wings, i.e. a web 115 U longitudinally extended on one side by a bearing wing 116 U forming with web 115 U an adjacent angle in contact with that 23*a* belonging to the supporting member and on the other side a locking cavity 33 extended laterally this web together with a flank 110 being slightly angled towards wing 116 U and extending projection 120. This mini-section receives bridges 151 (FIG. 5).

FIG. 22 illustrates a mini-section 106 of the same type as 105 but extruded in plastic or aluminum. It is characterized by its tubular central section and the locking possibility offered by a cut-out spur 410 in the top section of a pillar 71 for example fitted behind its flank 110.

FIG. 23 schematically illustrates a few of the possibilities offered by mini-sections of modular length in the solving of connection problems during the assembly of various supporting members according to the invention.

Thus mini-section 101, at left has a locking spur 135 cut out of web 110 and forms a finger concealable in the inside recess of the mini-section in the direction of arrow A. This finger 135 constitutes a ridge 136 against which the end of a pillar 70 of a bridge is thrust and via ridge 137 can constitute a locking of the intermediate panels if required.

Mini-section 101bis, shown above 101, differs in its locking recess 33 which is in this case modularly perforated at 33bis, over two radii 14 M located on either side of the flank, the notches 34 of wing 115 creating high friction on the internal angle 23*a* and contributing effectively to its locking. Holes 35 are perforations considerably larger than those 33bis in order to function together with dimensionally adapted spurs or to act as a crenellated arrangement of bridges.

At each of their two ends these mini-sections have a piece 38 into which can be inserted the wing of an angular decorative section of profile L 380 for which the end of the wings forms a hook 381 which is locked by the shell bridges 155, the holes 33bis making it possible to form angular connections thanks to an intermediate U-shaped piece 42 one end of which fits together with the internal longitudinal part of mini-section 38 and the other restricted end 43 can penetrate a hole 33bis. All these connections are conveniently made by welding on the basis of modular elements to form L, T, and X angle pieces. Other elements can use bent mini-sections 45 K, shown at right, which combine to form an assembly to which are added mini-section angle pieces made of a single piece of material and which have the same characteristics. These connections can be linked together in a composite structure thanks to the end perforations 44 which are intended to take suitable U-clips.

FIGS. 24 and 24A show the possibility of sliding a plate P of any material between deck 70 and flank 110, and of locking sections of varying shapes, such as a plastic slide-piece 470 for example or a rack 471.

FIG. 25 shows a plate of insulating material M locked into supporting member 56 by a minisection 101.

FIG. 26 shows a composite structure according to the invention, comprising a plastic shell bridge 160 in which the pillar 70 U have locking spurs 92 E, engaging an edge 96 of the associated supporting member a ribbed flat surface. The locking pillars 70 U can be concealed towards the inside of the bridge at the moment of insertion of the bridge. They can interconnect two longitudinally coupled supporting members 102, 102' which can have on their other faces additional bridges 152 of different pillar height.

FIG. 27 illustrates another one of the multiple adaptations of the invention. In this case the supporting member 102" has crenellated arrangement, in which each channel is formed by a substantially U-shaped trapezoidal section the wings of which are coupled to form another crenellated arrangement, being locked by mini-sections 103" of a suitable shape, which are in their turn locked by arched bridges 152.

The straight or angular mini-sections 101, 101bis, 102, 105, 106, 215 K, constitute reinforcements which are fitted and held by friction in all or part of the locking recesses of a channel element 56 of which they may form all or part of the flank thanks to their locking mini-recess which is profiled and/or perforated and/or shaped, on the web or the wing. The mini-sections fixed to the supporting members by the bridges, and vice versa, also constitute effective anchoring elements for new connections and fixing means for various accessories, such as door hinges for example or brackets for fitting shelves.

The straight or angular mini-sections constitute invisible tubular reinforcements in the volumes which they permit on the basis of supporting members of the same width and of the most simple shape for example C-sections.

The L and T-shaped angular mini-sections, fitted for example in the center or at the end of the locking recess of one or more supporting members can be joined by straight mini-sections by means of clips linking the end of each of the webs or flanks in contact, these straight mini-sections then acting as tighteners and inversely as support-rods. This combination is of particular interest in the making of angle-piece structures of volumes of widely varying form on the basis of independent supporting members the connections of which are thus fixed to one another. The perforated locking recesses of these tighteners can also serve as supports for cleats. The mini-sections can constitute effective means of fixing a plastic film for example which in the internal section of the supporting member can act as soundproofing for example and in the external section a means of forming decorative coverings supplemented or not with foam plastic as an intermediate substance.

Strong elastic anchoring of a bridge, such as 75, and optionally that of the mini-sections, according to the invention provides very effective elements for new connections, and a strong reinforcement of the supporting member, giving it all the advantages and qualities of an open or closed, sectoral, tubular, enclosed space. A number of bridges used can be such that it permits the attainment of the degree of reinforcement required.

These bridges provide tensioning and/or locking and/or resistance to deformation of the channel and of the two flanks of the supporting element, which for example permits by simultaneous use of tension and locking, the linking and strengthening of a wood or transparent plastic panel, for example with two sectional flanks, independent supporting members.

The described variations of the deck, bridges and mini-sections, according to the invention, permit the combined or separate formation of practically all rigid angular connections, beams, and other structural members.

The reinforcing and connecting bridges permit conversion, without the use of tools, of a flexible supporting member into a wall which has a rigidity adapted to a specific use, or the use of a bridge, mini-section combination to unite and/or reinforce supporting members, angularly or in the same plane, or by bridges joined back-to-back to form for example, with two C-shaped supporting member located opposite one another, an enclosed tubular space of variable rigidity.

Thus the invention facilitates the construction of substantially all types of composite structures, such as structures used in joinery or framework, for example in the form of main beams. It permits the filling in of open sections with plates M or P for example seated in the free space between two supporting members joined face-to-face and with or without locking sections. The sections can be decorative if required.

Relatively flexible plates can thus be rigidified by bridges. Their decks can be fixed for example by gluing or welding. Thanks to the instantaneous fitting of the supporting members, with or without mini-section, the plates, whether flat or angular or twisted, can thus be stiffened, decorated, and made connectable in every sense on one or two faces. The plates thus function as tensioning elements between the supporting members which can thus brace each other.

Tubular enclosed spaces can be formed by supporting members and bridges and can be hermetically sealed either by a U-shaped external sheathing which encases the supporting member and which is fixed by the friction of their lateral wings in contact with one another and the deck of the bridges can be connected to the internal web of the U-sheath by adhesive or magnetic means; or by a C-shaped external sheathing, fixing in this case being by mechanical means i.e. by a trapezoidal locking flange forming part of the bridge deck.

The tubular enclosed spaces constitute an effective method functional and decorative and economic walls and accessory volumes, there being the possibility as in all applications of the invention of using angular decorative elements secured either by the bridges and/or the mini-sections.

FIG. 27 illustrates a bridge 157' in which a reinforced deck 76 K has two pillars 70 C, the base of which has wing 69 turned towards the outside of the bridge, the spurs 92 being turned towards its inside, acting on facing mini-section 101. The reciprocity of their shape and the various locking devices of these mini-sections contribute to very efficient fixing of bridge 157bis.

FIGS. 28; and 29 illustrate two types of a tubular composite member, providing an enclosed space, made by a supporting member 56 joined to bridges 152.

FIG. 28 space 568 is shown where the bridge deck 76 has a 2-sided adhesive film which adheres to the internal web 371 of a U-section bridge 370 of which the internal parts of its two lateral wings 372 come into contact with the outsides of wings 22*a,* and optionally wing 372' of a section of similar shape can be inserted between wings 372 and wing 22*a* in order to form a chain of tubular spaces, as indicated by dotted lines.

FIG. 29 shows a space 369 formed by an external sheath 360, the mechanical connection being by means of a flange 379 connected to bridge deck 76. Two flexible lateral wings 377 can be compressed towards wing 22*a* to permit the fitting of sheath 360, and can then, due to their elasticity, be locked in the angle 23*a.*

Figure 30:
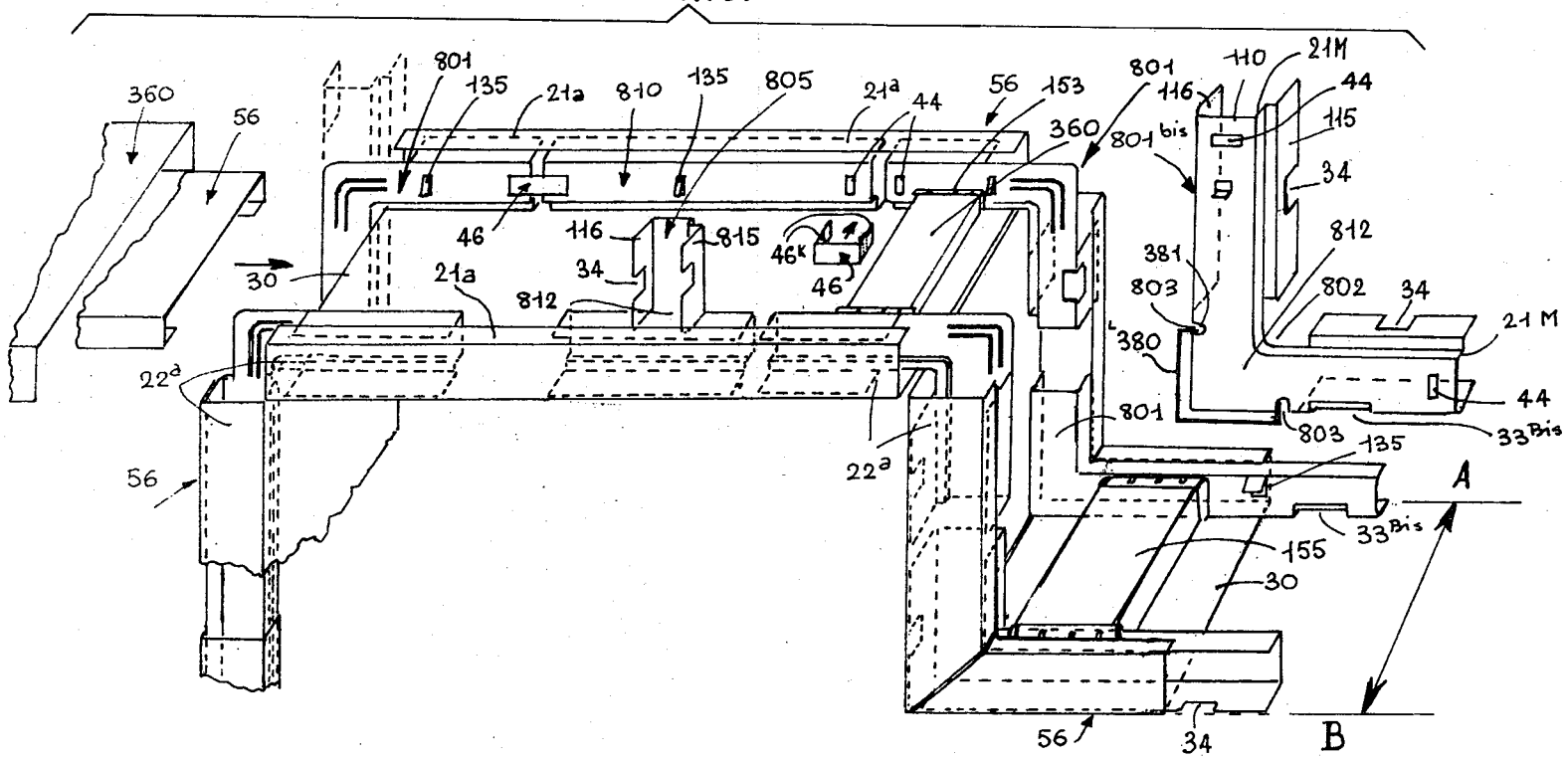

FIG. 30 shows still another of the multiple rigid assemblies permitted by the invention. The left-hand part of this figure shows an angular arrangement in which the two opposite wings 22*a* are cut, bed 30 being folded to a right-angle. The right-hand section of the figure shows the supporting member assembled and also reinforced being linked by modular mini-sections of angular type 801bis which are themselves locked by shell bridge 155.

This use of modular angle-sections 801 and 801bis possesses all the advantages described above in relation to other mini-sections. In addition, angle-sections 801 and 801bis are different in that they are made from a single cut and shaped sections i.e. a flank 110 or rigid angulate web which can have spurs or perforations or the like, if desired, longitudinally extended, and on each of its two sides a relatively flexible wing 115 and 110 and constituting at least one of the two branches of these angle-sections. They can have either L or T or X shape in cross-section.

These angle-sections have the common feature of having a central angular section 812 disengaged from the section of the wings fitting into the locking recess of supporting member 56, angle-section 801bis being reinforced by a mini-wing 802 which is the bent extension of wing 21M contiguous to flank 110 or central web which in its central angular section 812, a little before the start of wings 116, has notches 803, intended to hold a L-section angular decorative strip 380 with locking wings 381.

In the center of FIG. 30 can be seen a T angle-section 805 of which the base of wings 116 and 115 is in contact with the outside of wing 21*a.* All these connections are in fact made possible by the fact that flanks 110 are disengaged from wings 21*a,* which permits all angular extensions To provide even greater security for the connections, the central mini-section 101bis forms a leg or tightener 810 between two L angle-sections 801 by means of a clip 46 which has a U-shape and has two lateral wings each having a locking spur 46R for blocking this clip 46 in adjacent perforation 44 belonging respectively to angle-section 801 and mini-section tightener 810.

Finally, the rigidity of supporting member 56 and the locking of the mini-sections is obtained due to the thrust marked at A and B which is constituted by fitted bridge 155 and small bridges 153 forming a shell by means of a sheath 360.

The non-limitative embodiments, described above, can be optionally made of a thin or thick material, and since thin materials offer the greatest difficulty they have been chosen as examples by preference. Furthermore, all the connections can be given supplementary bonding, and the hollow arches of the bridges, like the recesses of the mini-sections, constitute supplementary connecting devices due to the possibility of inserting or sliding sections of variable shape into the open space, which is thus doubly locked.

What is claimed is:

1. A composite structure, comprising:

a. an elongate supporting member having a generally U-shaped cross-sectional configuration, the arms of which provide two longitudinal flanks of said member and said U-shaped configuration providing a web between said arms, at least part of at least one of said flanks having at least one longitudinal recess of a generally C-shaped cross-sectional configuration; and b. a plurality of bridge members disposed to stiffen the elongate supporting member, each bridge member comprising a rigid deck, at least two rigid piers, one at each end of said deck, and sharp-edged spur means on at least one of said piers engageable with the supporting member, said bridge members being spaced apart along the elongate supporting member, each bridge member having its deck extending between said flanks and spaced from said web;

at least one of said members being resilient to enable the bridge members to be clamped transversely in the supporting member with said spur means engaging said flanks, to resist any wrenching and longitudinal displacement of the bridge members.

2. A structure according to claim 1 including at least one minisection which comprises an auxiliary elongate member separably engageable with the supporting member and the bridge members and extending along the supporting member to cooperate therewith and with the bridge members in the clamping of the bridge members in the supporting member.

3. A structure according to claim 2 wherein each minisection comprises first and second wings parallel to and approximately coextensive with the support member, and means interconnecting said wings to define a tubular section by said wings and supporting member.

4. A structure according to claim 2 including a second supporting member extending along the first-mentioned supporting member, and means for interconnecting the supporting members, comprising at least one of the minisections extending along the two supporting members.

5. A structure according to claim 2 wherein at least one of the minisections comprises means for rigidifying at least parts of the supporting member.

6. A structure according to claim 1 including a second support member extending along the first, and means including at least one of the bridge members for interconnecting the two support members.

7. A structure according to claim 1 in which at least two of said bridges have their decks joined back-to-back, each having a first half-deck integrally extending from at least one of its piers, a second half-deck similarly extending and facing the first half-deck and a cross-bracing flange between the half-decks and secured thereto.

8. A structure according to claim 7 in which the cross-bracing flange has a substantially U-shaped cross-sectional configuration and is disposed to enable the two bridges, joined by their decks, to be locked to similar co-planar bridges of another supporting member.

9. A structure according to claim 2 in which the auxiliary support member has a generally C-shaped cross-sectional configuration which fits into and engages the longitudinal recess of one of the longitudinal flanks of the elongate supporting member.

* * * * *